US005096030A

United States Patent [19]

Espinosa et al.

[11] Patent Number: 5,096,030

[45] Date of Patent: Mar. 17, 1992

[54] LUGGAGE UNIT WITH PULL-OUT ARTICLE-RECEIVING POUCH

[76] Inventors: Erlinda O. Espinosa; George J. Espinosa, both of 752 Atherton Cir., Salinas, Calif. 93906

[21] Appl. No.: 735,589

[22] Filed: Jul. 25, 1991

[51] Int. Cl.[5] ..... A45C 3/12; A45C 13/02

[52] U.S. Cl. ..... 190/108; 190/110; 190/901

[58] Field of Search ..... 190/27, 36, 108, 110, 190/901

[56] References Cited

U.S. PATENT DOCUMENTS

| | | | |
|---|---|---|---|
| 1,705,149 | 3/1929 | Brady . | |
| 1,806,246 | 5/1931 | Feldman et al. | 190/108 |
| 2,107,180 | 2/1938 | Gihon . | |
| 3,861,504 | 1/1975 | McGraw | 190/110 |
| 4,260,004 | 4/1981 | Domke | 190/110 |
| 4,273,223 | 6/1981 | Tomlinson . | |
| 4,386,642 | 6/1983 | Durbin . | |
| 4,463,789 | 8/1984 | Leiserson . | |
| 4,506,769 | 3/1985 | Franco . | |
| 4,513,866 | 4/1985 | Thomas | 190/110 |
| 4,580,667 | 4/1986 | Herwood | 190/108 |
| 4,629,066 | 12/1986 | Howard | 190/110 |
| 4,854,432 | 8/1989 | Carpenter . | |
| 4,887,751 | 12/1989 | Lehman . | |

*Primary Examiner*—Gary E. Elkins
*Attorney, Agent, or Firm*—Townsend and Townsend

[57] ABSTRACT

An improved luggage unit which has hollow spaces for receiving pouches in which toilette articles or other articles can be placed. The luggage item has quick release fastening structure on the inner walls for releasably connecting the pouches to the interior of the luggage unit. Thus, the pouches can be readily separated from and placed in the luggage unit and placed at a convenient location for access to the contents of the pouches. Snaps made of webbing are attached to the top of the pouches. Thus, the pouches can be placed adjacent to a horizontal bar, such as a towel rack, and allowed to be suspended from the bar. This is especially important when the bar is close at hand to the location at which the articles are to be used, such as a bathroom having a towel rack near a lavatory.

9 Claims, 2 Drawing Sheets

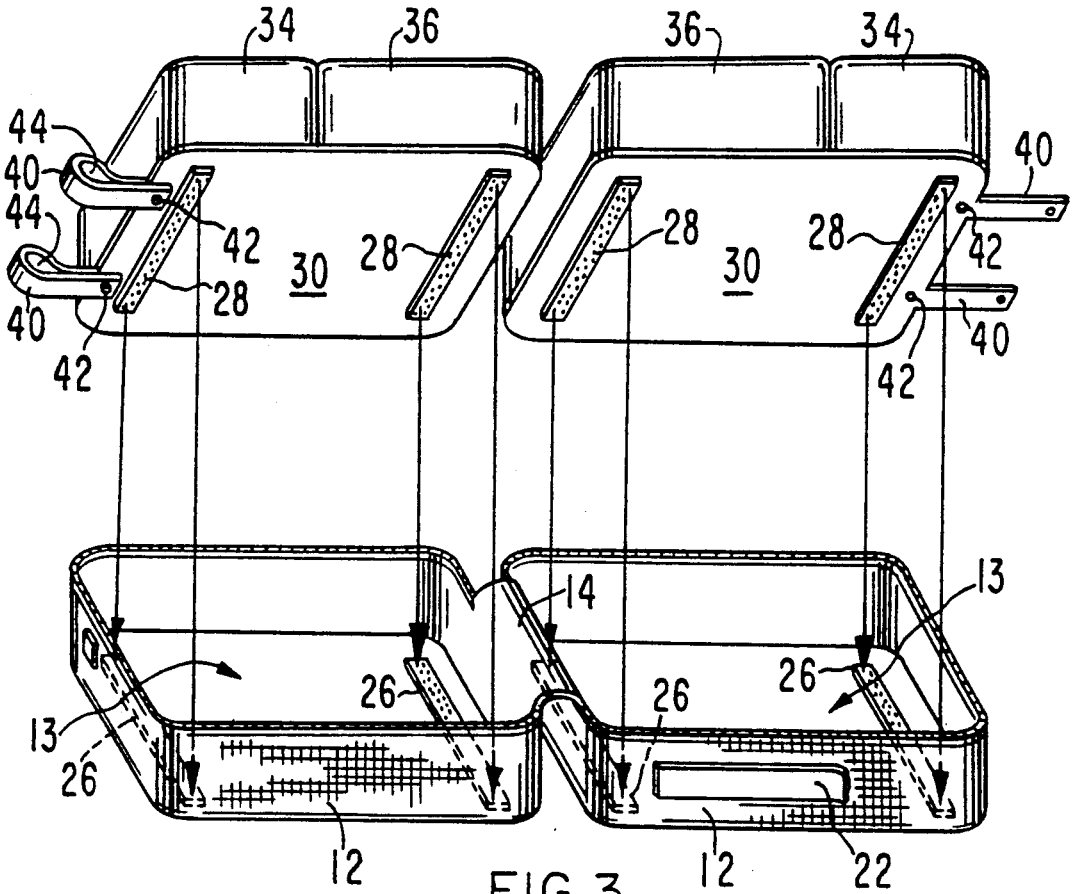
FIG. 3
FIG. 4
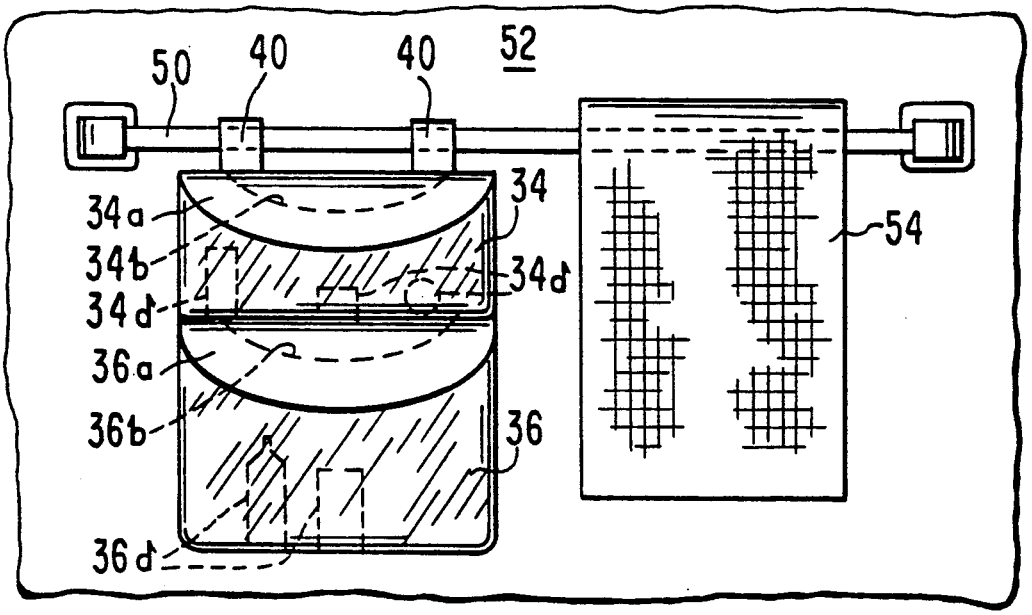

LUGGAGE UNIT WITH PULL-OUT ARTICLE-RECEIVING POUCH

This invention relates to improvements in luggage for articles of different types and, more particularly, to a luggage unit having article-receiving pouches therein.

BACKGROUND OF THE INVENTION

Luggage pieces generally, come in many sizes, shapes and materials. A typical luggage piece is one which is made of nylon or other heavy duty flexible, wear resistant material. The luggage piece has two hollow halves and has a zipper which can be zipped up to couple the two halves together to form a closed case for containing clothing and other articles. Disclosures relating to luggage pieces are found in the following U.S. Pat. Nos.: 1,705,149, 2,107,180, 4,273,223, 4,386,642, 4,463,789, 4,506,769, 4,854,432, 4,887,751.

For travelers, for instance, it is often desirable to provide a separate container for toilette articles and other articles of a general type which are carried in a luggage piece.

Sacks, bags or other containers are not, over time, adequate to preserve order in the arrangement of toilette articles when such containers are loosely carried in a luggage unit goods of a particular group of articles. It is desirable that toilette articles be kept together, such as during an overnight stay in a motel, so that such articles will be accessible at any time. A need, therefore, exists for improvements in luggage which keeps toilette articles together as a group and the present invention provides a luggage unit which satisfies this need.

SUMMARY OF THE INVENTION

The present invention is directed to an improved luggage unit which has hollow spaces for receiving pouches or containers in which toilette articles or other articles can be placed. The luggage unit has quick release fastening structure on the inner walls for releasably connecting the pouches or containers to the interior of the luggage unit. Thus, the pouches can be readily separated, from and placed in the luggage unit and, when separated can be placed at a convenient location for access to and use of the contents of the pouches.

Another important feature of the present invention is the use of snaps on webbing material and attached to the top of the pouches. Thus, the pouches can be placed over a horizontal bar, or similar structure, and allowed to be suspended from the bar. This is especially important when the bar is close at hand to the location at which the articles are to be used, such as a bathroom having a towel rack near a lavatory.

The primary object of the present invention is to provide an improved luggage unit which has pouches or containers in which articles can be placed to group the articles together yet allow the pouches or containers to be separated quickly and easily from the luggage unit and suspended near the point of use to thereby simplify the carrying, holding and using the articles yet the luggage unit itself is simple and rugged in construction, can be made at minimum cost, and can be used as a carry-on bag for articles of different types.

Other objects of this invention will become apparent as the following specification progresses, reference being had to the accompanying drawings of an illustration of the invention.

BRIEF DESCRIPTION OF THE DRAWINGS

FIG. 3 is a perspective view of the unit in its completely opened condition with the pouches or containers separated from the luggage unit; and FIG. 4 is a front elevational view of a pouch or container suspended from a towel rack to illustrate the accessibility of the articles in the pouches or containers.

DETAILED DESCRIPTION OF THE DRAWINGS

Figure 2:
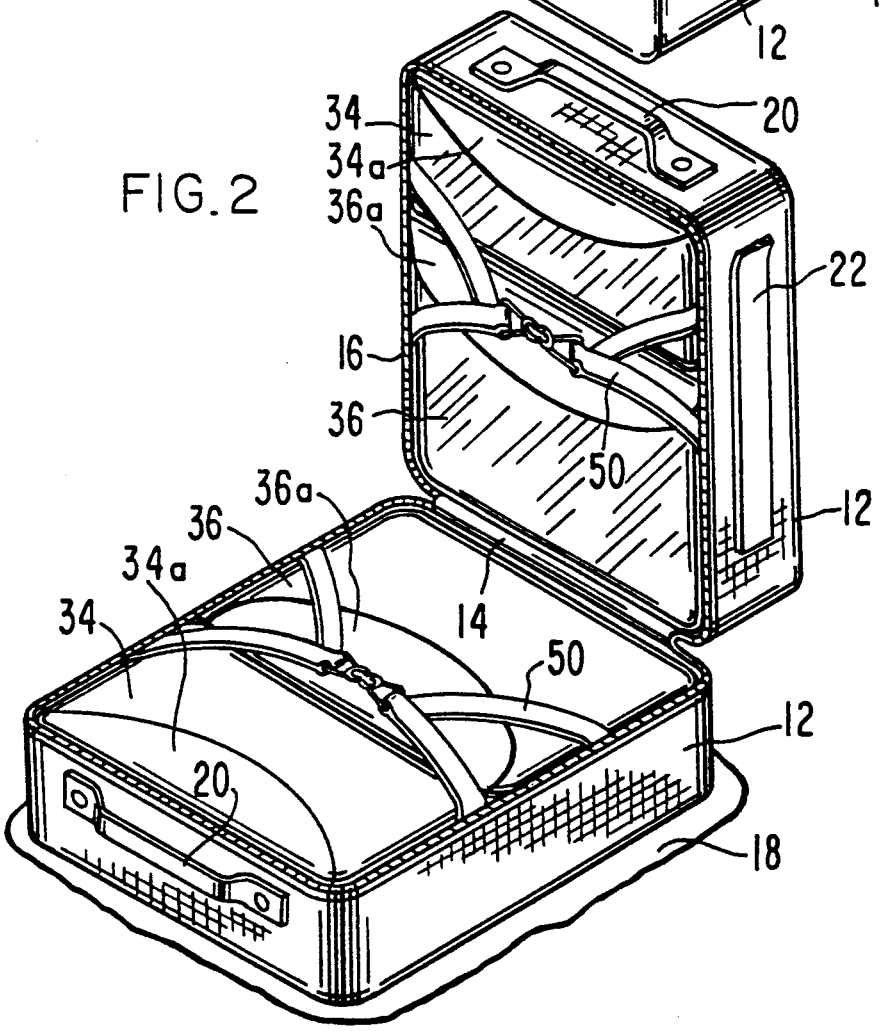
FIG. 2 is another perspective view of the unit with the unit open and showing the pouches or containers held in the unit.

The luggage unit of the present invention is broadly denoted by the numeral 10 and includes a pair of hollow members or halves 12 which are hinged together at flexible hinge 14 (FIGS. 2 and 3). Hinge 14 can be of any construction but preferably it is an extension of the sheet material which lines the members 12. Such material can be a flexible synthetic material, such as nylon.

Figure 1:
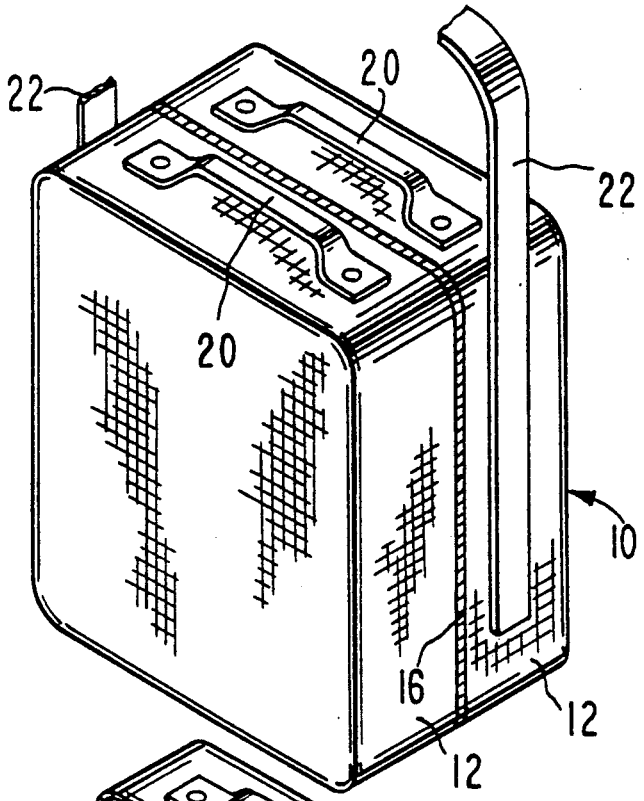
FIG. 1 is a perspective view of the luggage unit of the present invention, showing the unit in a closed condition.

The members 12 mate in a manner shown in FIG. 1, and, when mated, a zipper 16 interconnects the members on the two sides and the top so that the luggage unit 10 can be closed in the manner shown in FIG. 1. When the luggage unit is partially open, it has the configuration shown in FIG. 2. One of the members 12 can rest on a surface 18 while the other member can extend upwardly from hinge 14 in a manner shown in FIG. 2. In the fully open position of FIG. 3, both members 12 can rest on surface 18.

The luggage unit 10 has a pair of handles 20 on the tops of respective members 12. The handles allow the bag to be hand held. A shoulder strap 22 can be coupled to the bottoms of the members 12. Other zippered pockets (not shown) can be formed in the sides and ends of the members 12 for other articles, such as articles of clothing. However, members 12 are hollow to present an open space 13 in each member 12, respectively, spaces 13 being shown in FIG. 3.

Each of spaces 13 is provided with a pair of spaced, first Velcro strips 26 (FIG. 3). These first Velcro strips are parallel with hinge 14 and are mated with second Velcro strips 28 on the back sides 30 of panels 32 having pouches 34 and 36 mounted on the front or upper faces thereof as shown in FIG. 3. The pouches 34 and 36 are adapted to contain articles of a general type, such as toilette articles are used in a bathroom.

Preferably, the pouches 34 and 36, one of which is larger than the other, are made of a suitable transparent plastic which is washable or otherwise cleanable. While panels 32 have been described as connected to the backs of the pouches, it is clear that panels 32 could be omitted and a flexible, plastic back wall can be used which is common to both pouches 34 and 36 or the two pouches can be separate from each other. The pouches 34 and 36 have upper end flaps or closures **34*a* and 36*a* (FIG. 4) for closing the top openings 34*b* and 36*b* of the pouches (FIG. 4) by means of which the articles 34*d* and 36*d*** in the pouches can be removed and replaced as desired.

Each pair of pouches 34 and 36 has a pair of spaced, flexible straps 40, such as webbing material, secured in any suitable manner to panels 32. Straps 40 are capable of being doubled upon themselves and to be fitted with snap fasteners 42 to form loops 44 when the elements of fastener 42 snap together. Straps 40 allow the pair of pouches 34 and 36 to be suspended singly or as a pair from a horizontal bar 48 of a towel rack 50 mounted on a wall 52. A towel 54 is shown in FIG. 4 on the bar 48 adjacent to the pair of pouches 34 and 36.

In use, the two pouch pairs 34 and 36 are placed in spaces 13 of respective members 12. Typically, panels 32, if such panels are used, are substantially of the same size and configuration as their respective spaces 13. When the pouch pairs are placed in spaces 13, the Velcro strips 26 and 28 mate and releasably interconnect the halves or members 12 to the rear panels 32 or back walls of the pouch pairs. The pouch pairs are then snugly fitted in the members 12 in the manner shown in FIG. 2. Cross-straps 50 can be used to assure that the pouch pairs are set deeply enough into the spaces 13 so that the bag can be closed. When closed, the bag can be secured by zipper 16 in a manner shown in FIG. 1.

Arriving at a destination, the user can open the bag, lift the pouch pairs out of the bag as shown in FIG. 3 and hang each pouch pair in the manner shown in FIG. 4 on a bar, such as a towel rack 48.

What is claimed is:

1. A luggage unit comprising:

a case having a pair of hollow members with each member having an opening;

pouch means for each member, respectively, for containing articles to be carried by the case, said pouch means being insertable into a respective member through the opening thereof; and quick release fastening means between the members and the pouch means for releasably holding the pouch means in the members.

2. A luggage unit as set forth in claim 1, wherein said quick release fastening means includes Velcro strips.

3. A luggage unit as set forth in claim 1, wherein each member has an inner flat surface, said pouch means including a wall for juxtaposition with the inner surface of the corresponding member, said quick release fastening means including Velcro strips on said surface and said wall.

4. A luggage unit as set forth in claim 1, wherein said fastening means includes cross-straps carried by the case for each member, respectively.

5. A luggage unit as set forth in claim 1, wherein said pouch means includes a pair of hollow pouches with each patch having a closure at the top thereof.

6. A luggage unit as set forth in claim 1, wherein said pouch means includes a pair of pouches for each member, respectively, the pouches having a common wall at the back side thereof, said pouches and said wall being removable from the respective member as a group.

7. A luggage unit as set forth in claim 1, wherein is included strap means carried by the pouch means for suspending the pouch means from a bar.

8. A luggage unit as set forth in claim 7, wherein such strap means include a pair of spaced straps having fastening means for forming loops for mounting on the bar.

9. A luggage unit as set forth in claim 7, wherein said pouch means includes a pair of vertically spaced pouches, with each pouch having a top opening provided with a top closure flap, the strap means being adjacent to the upper margin of the pouch means.

* * * * *